US007500492B2

(12) United States Patent
Mitoraj

(10) Patent No.: US 7,500,492 B2
(45) Date of Patent: Mar. 10, 2009

(54) DEVICE FOR DISBURSING UNDERGROUND A LIQUID DISCHARGED FROM A SUMP PUMP

(76) Inventor: Mark Mitoraj, 2427 Grape St., Joliet, IL (US) 60435

( * ) Notice: Subject to any disclaimer, the term of this patent is extended or adjusted under 35 U.S.C. 154(b) by 567 days.

(21) Appl. No.: 11/129,882

(22) Filed: May 16, 2005

(65) Prior Publication Data

US 2006/0254672 A1 Nov. 16, 2006

(51) Int. Cl.
*F16K 37/00* (2006.01)
*E02B 11/00* (2006.01)

(52) U.S. Cl. ..... 137/551; 405/43; 405/36

(58) Field of Classification Search ..... 137/551; 405/39, 41, 43
See application file for complete search history.

(56) References Cited

U.S. PATENT DOCUMENTS 101,744 A * 4/1870 Knacker ..... 405/43
207,378 A * 8/1878 Worthen ..... 137/551
1,114,967 A * 10/1914 Cooke et al. ..... 405/43
1,281,427 A * 10/1918 Steelquist ..... 405/41
1,401,386 A * 12/1921 Woodberry ..... 405/45
1,992,991 A * 3/1935 Colley ..... 137/551
2,052,020 A * 8/1936 Black ..... 405/39
2,309,233 A * 1/1943 Black ..... 405/45
6,270,661 B1 * 8/2001 Jowett ..... 405/43

* cited by examiner

*Primary Examiner*—John Rivell
(74) *Attorney, Agent, or Firm*—Cherskov & Flaynik

(57) ABSTRACT

A device 10 for disbursing underground a liquid discharged from a sump pump 8 includes an underground liquid disbursing conduit 12 secured to a vertical conduit 14 extending upward from the underground liquid disbursing conduit 12 to a connector conduit 16, a bypass member or discharge conduit 18 secured to an upper portion 20 of the connector conduit 16, the bypass member 18 allowing liquid to be discharged above ground in the event the underground liquid disbursing conduit 12 or the vertical extending conduit 14 become plugged, and a means for directing liquid flow from the sump pump 8 to the conduit connector 16.

14 Claims, 8 Drawing Sheets

DEVICE FOR DISBURSING UNDERGROUND A LIQUID DISCHARGED FROM A SUMP PUMP

BACKGROUND OF THE INVENTION

1. Field of the Invention

The present invention relates to underground liquid disbursing devices and/or systems that utilize underground perforated polyvinyl chloride ("PVC") or corrugated pipes to distribute and dissipate a liquid flow discharged from a sump pump.

2. Background of the Prior Art

Prior art underground liquid disbursing devices and/or systems utilize an open conduit configuration when routing liquid flow from a sump pump to underground disbursing conduits. More specifically, the prior art conduit configuration includes an above ground conduit portion having a first end connected to the sump pump and a second open end disposed above and separated from an open above ground end of an underground conduit portion. The open above ground end is disposed a relatively small distance above an adjacent ground surface. The open above ground end of the underground conduit is relatively larger in diameter than the diameter of the above ground conduit. Also, the distance separating the open second end of the above ground conduit portion from the open above ground end of the underground conduit portion, is sufficient to allow debris or other foreign objects to fall into the open above ground end resulting in the plugging or reduced liquid disbursement capability of the underground conduit portion.

Further, prior art underground liquid disbursing devices and/or systems cannot be pressurized with a purging or "clean out" liquid such as water to unplug or otherwise clean the underground conduit portion via pressurized water. Also, the prior art devices and/or systems do not provide an indication when liquid flow from the sump pump has discharged upon the ground surface thereby visually displaying that the underground conduit portion is plugged or that the disbursement capacity of the system has been reduced, or that the sump pump is providing a quantity of liquid exceeding the disbursing capability of the system.

A need exists for a closed conduit device and/or system that disburses underground a liquid discharged from a sump pump thereby preventing debris or other foreign objects from falling into underground conduit portions. Further, a need exists for the device and/or system to indicate when underground conduit portions are plugged or clogged with material such that liquid disbursement capacity is reduced. Also, a need exits for the device and/or system to accept pressurized water to clean or "break up" material build-up in the underground conduit portions.

SUMMARY OF THE INVENTION

It is an object of the present invention to overcome many of the disadvantages associated with disbursing underground a liquid discharged from a sump pump.

A principle object of the present invention is to provide a device that does not allow debris or foreign objects to enter the device thereby plugging and preventing the device from disbursing underground a liquid flow from a sump pump. A feature of the device is a closed a conduit system having no openings through which debris or foreign objects could fall. An advantage of the device is that the no debris enters the device, but should the device fail to disburse liquid flow from a sump pump due to excessive flow or other conditions, the liquid flow is discharged out of the device onto a ground surface thereby preventing damage to the device and/or the sump pump.

Another object of the present invention is to provide a device that does not discharge liquid flow from a sump pump above ground during normal operation of the device. A feature of the device is a conduit having an arcuate portion that directs liquid flow downward into a vertical conduit connected to an underground disbursing conduit. An advantage of the device is that landscaping adjacent to the device is not damaged by a liquid flow from a sump pump that might include oil, gas or toxic substances.

Yet another object of the present invention is to provide a device that indicates when liquid flow has been discharged from the device onto the adjacent ground surface. A feature of the device is an internal ping pong ball supported by a string secured to an upper portion of the device. An advantage of the device is that the ping pong ball remains hanging from the device after liquid flow has ceased being disbursed from the device above ground thereby providing an owner notice that abnormal conditions were and/or are present in the operation of the device or sump pump.

Still another object of the present invention is to provide a device having portions that are quickly replace with larger or different configurations to accommodate sump pump variations. A feature of the device is a quick release fitting that secures a conduit connector and reducer portion assembly to a vertical conduit. An advantage of the device is that a "trial and error" approach can be taken when deciding the optimum device for an existing sump pump installation.

Another object of the present invention is to provide a device having means for securing a pressurized water line to a portion of the device that discharges liquid flow from the sump pump upon the ground surface. A feature of the device is a threaded, downward facing portion of a bypass member, the downward facing portion including a liquid flow discharge aperture that directs liquid flow from the sump pump upon the ground surface. Another feature of the device is an isolation valve that prevents liquid flow from the sump pump to a conduit connector portion of the device. An advantage of the device is that the downward facing portion and aperture therein prevent debris from falling into or otherwise entering the device, while allowing internal access to the device with pressurized water to purge and clean the device for maximum liquid disbursing capability.

Briefly, the invention provides a device for disbursing underground a liquid discharged from a sump pump comprising an underground liquid disbursing conduit; a vertical conduit extending upward from said underground liquid disbursing conduit to a connector conduit; bypass means secured to an upper portion of said conduit connector, said bypass means allowing liquid to be discharged above ground in the event said underground liquid disbursing conduit or said vertical extending conduit become plugged; and means for directing liquid flow from the sump pump to said conduit connector whereby the liquid flow is directed to said liquid disbursing conduit.

Also, the invention provides a device for preventing plugging of a sump pump liquid disbursing system comprising a vertical conduit secured to an above ground portion of an existing underground liquid disbursing conduit; a connector conduit having a lower end with an aperture, said lower end being removably secured to an upper portion of said extension conduit, said connector conduit including an upper end and a flow directing portion extending from a mid-portion of said connector conduit; a discharge conduit having a first end with an aperture, said first end being removably secured to said upper end of said connector conduit, said discharge conduit having a second end with a liquid discharge aperture directed toward a ground surface; and means for indicating that liquid from the sump pump liquid disbursing device has discharged from said liquid discharge aperture.

Further, the invention provides a method for unplugging a sump pump liquid disbursing device, said method comprising the steps of extending upwards an above ground conduit portion of an existing underground liquid disbursing conduit; providing a connector conduit having a first end removably secured to said extended above ground conduit portion, said connector conduit having a mid-portion secured to an existing sump pump discharge conduit, said mid-portion being configured to direct liquid flow from the existing sump pump discharge conduit into said extended above ground conduit portion, said connector conduit having a second end disposed above said mid-portion a predetermined distance that facilitates the path of liquid flow from the existing sump pump discharge conduit into said above ground conduit portion; providing a discharge conduit having a first end secured to said second end of said connector conduit, said discharge conduit having a second end with a discharge aperture for allowing the liquid from the existing sump pump discharge conduit to flow upon a ground surface when said sump pump liquid disbursing device becomes plugged, said second end having means for removably securing a pressurized water conduit thereto; and isolating said connector conduit from the existing sump pump discharge conduit, whereupon pressurized water is supplied to said connector conduit via said discharge conduit to direct pressurized water through said extended above ground conduit portion and into the existing underground liquid disbursing conduit thereby unplugging said sump pump liquid disbursing device.

BRIEF DESCRIPTION OF THE DRAWINGS

These and other objects, advantages and novel features of the present invention, as well as details of an illustrative embodiment thereof, will be more fully understood from the following detained description and attached drawings, wherein.

DESCRIPTION OF THE PREFERRED EMBODIMENT

Figure 1:
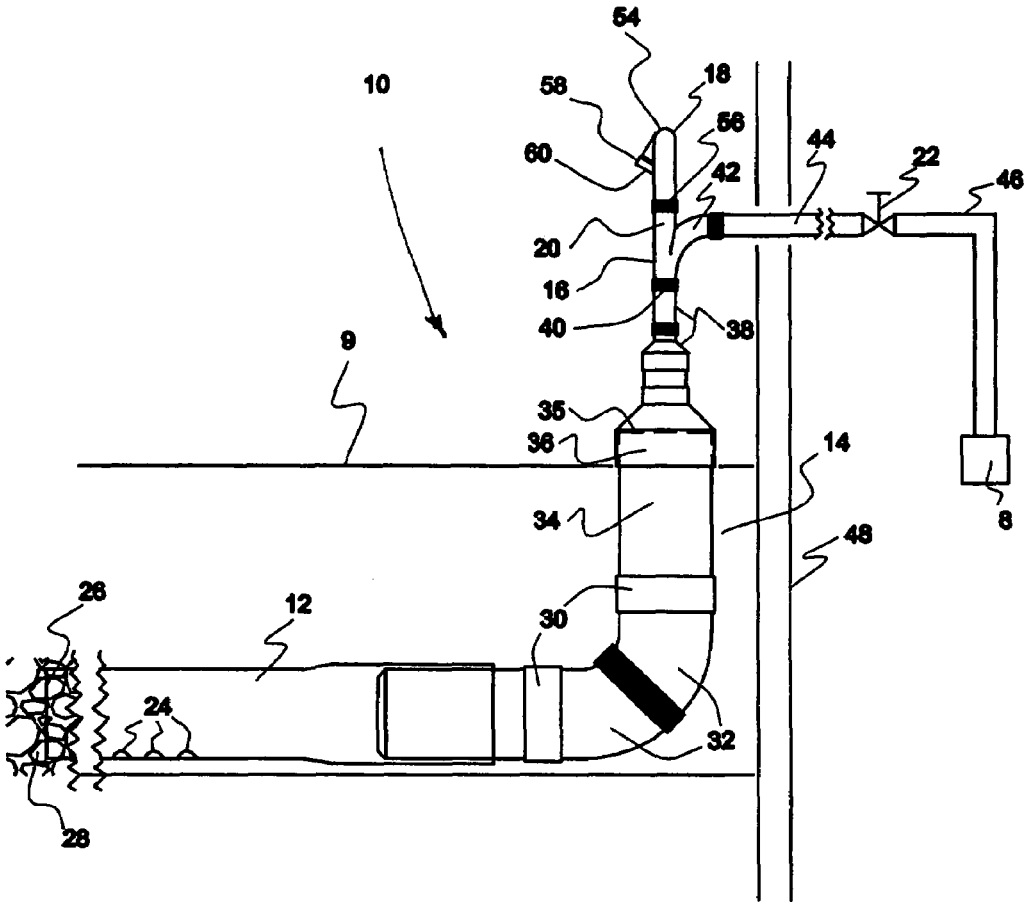
FIG. 1 is a front elevation view of a device for disbursing underground a liquid discharged from a sump pump in accordance with the present invention.
Figure 2:
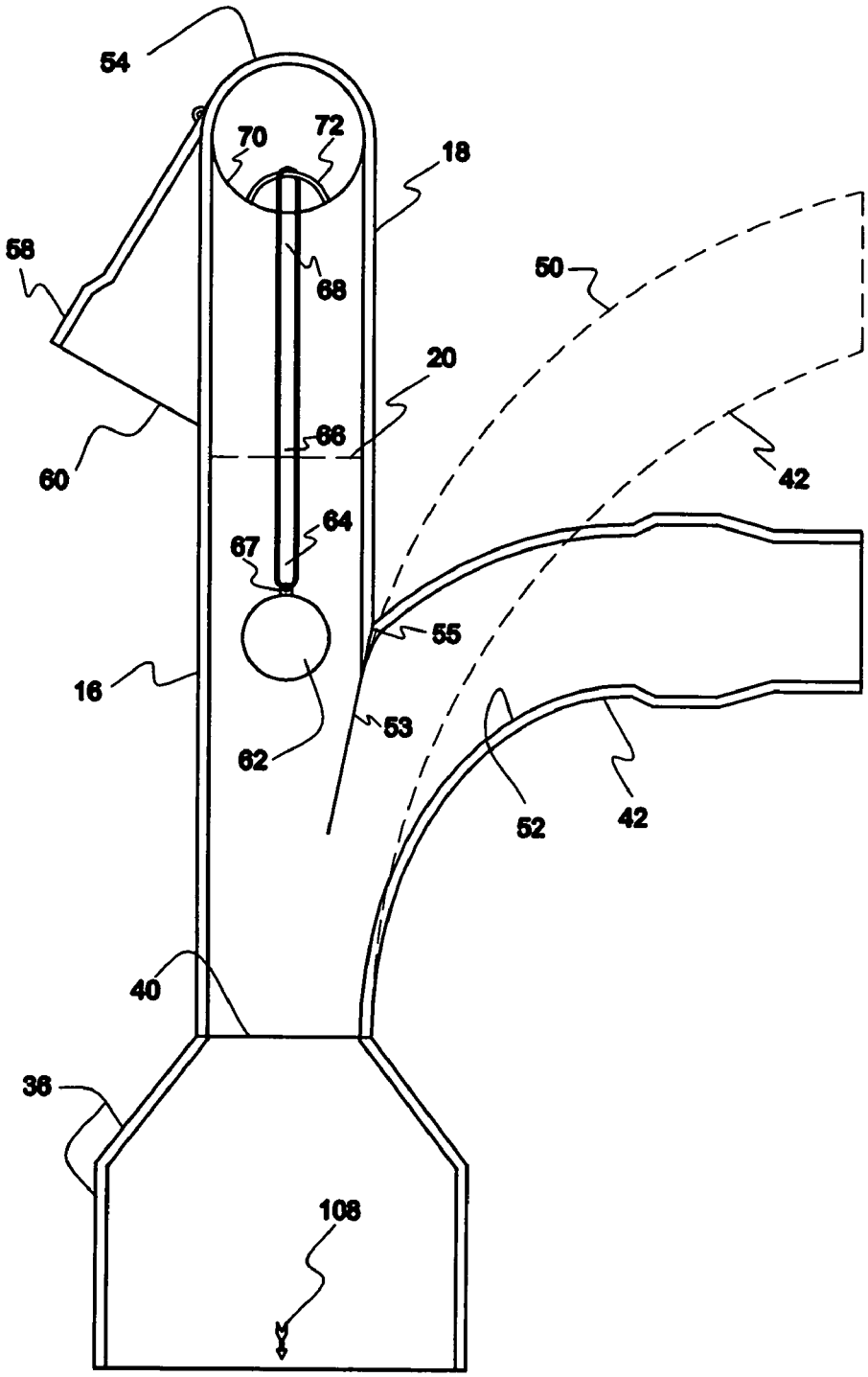
FIG. 2 is a front elevation, cutaway view of a conduit connector secured to a reducer portion in accordance with the present invention.
Figure 3:
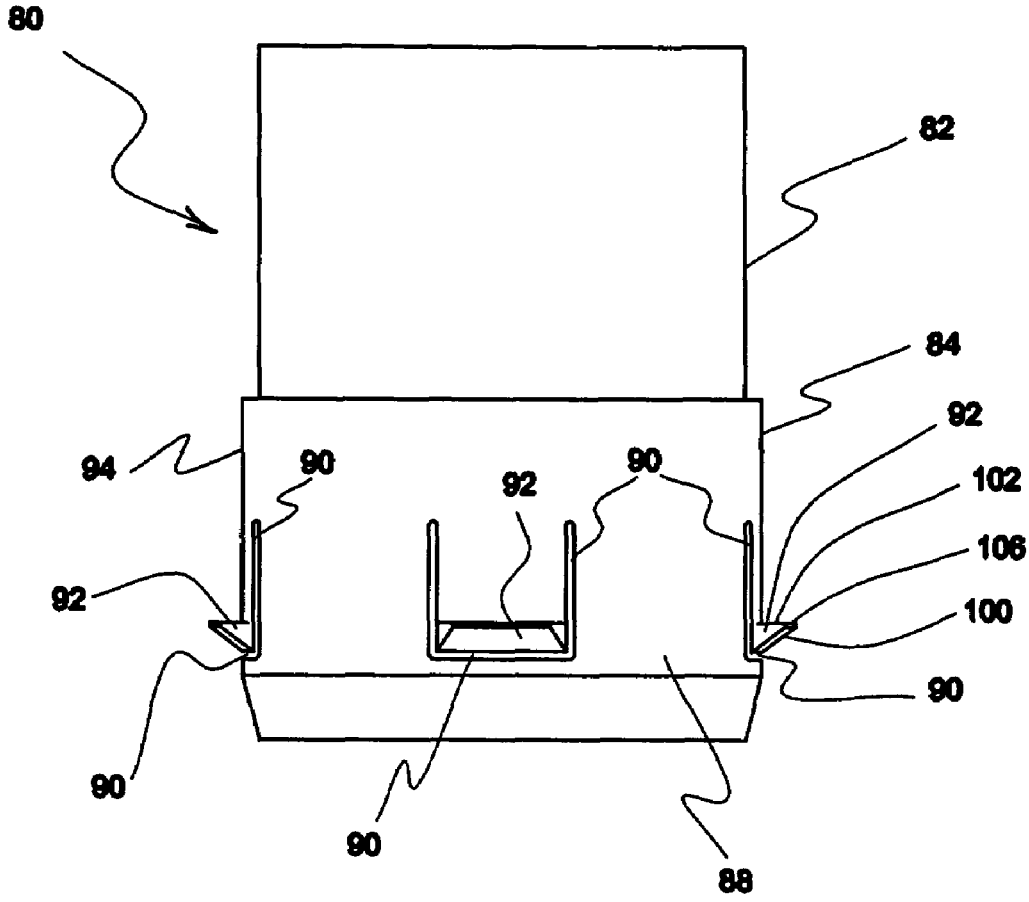
FIG. 3 is a front elevation view of a quick release fitting in accordance with the present invention.
Figure 4:
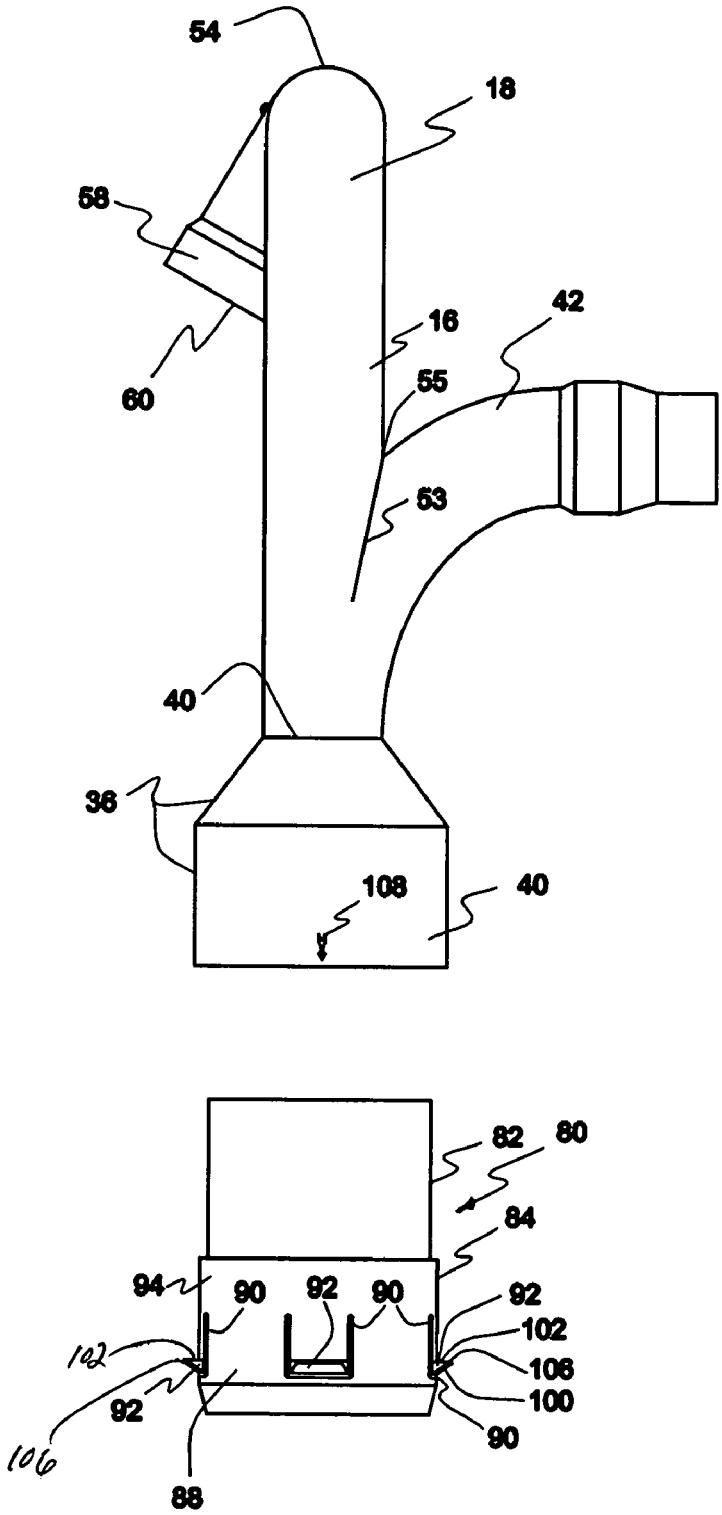
FIG. 4 is a front elevation view of a conduit connector secured to a reducer portion which is disposed above an insertion portion of a quick release fitting in accordance with the present invention.
Figure 5:
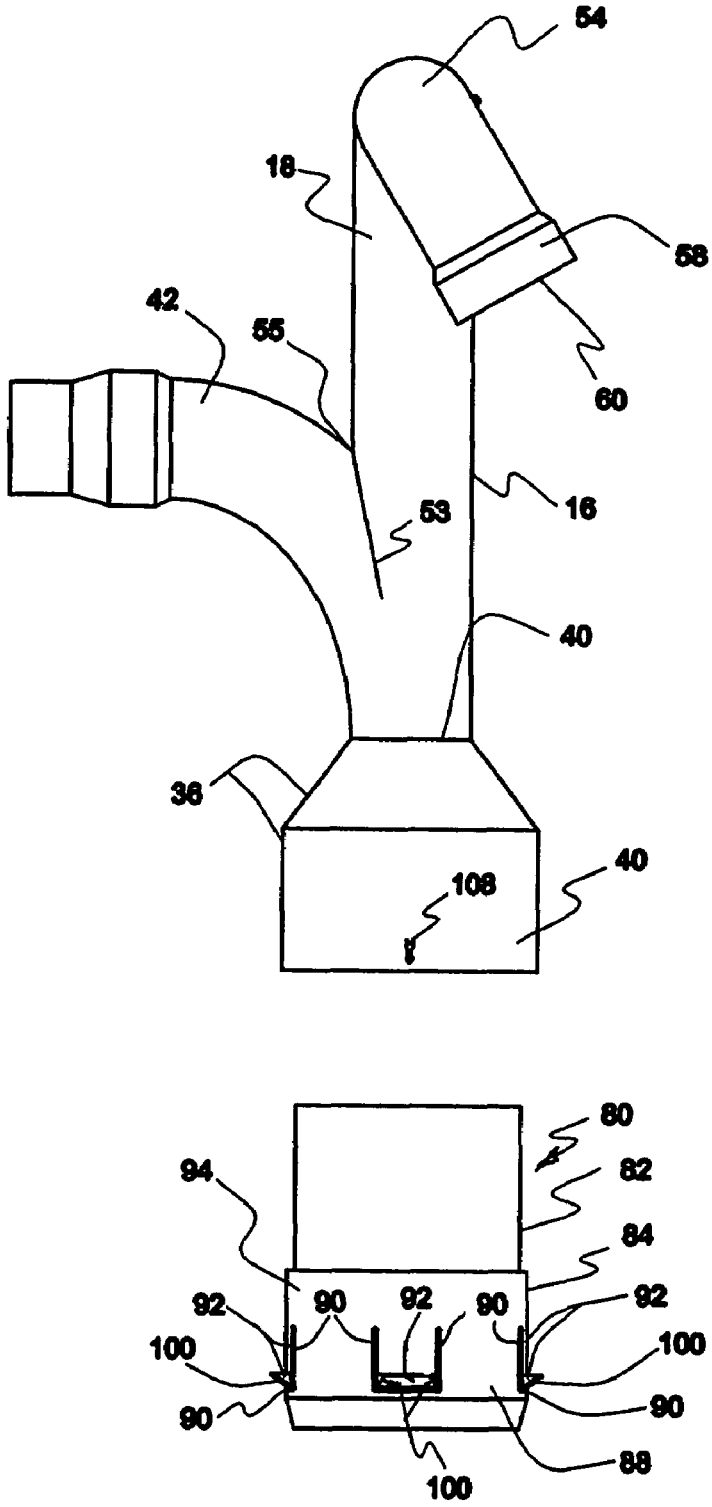
FIG. 5 is a back elevation view of the conduit connector, reducer portion and quick release fitting of FIG. 4.
Figure 6:
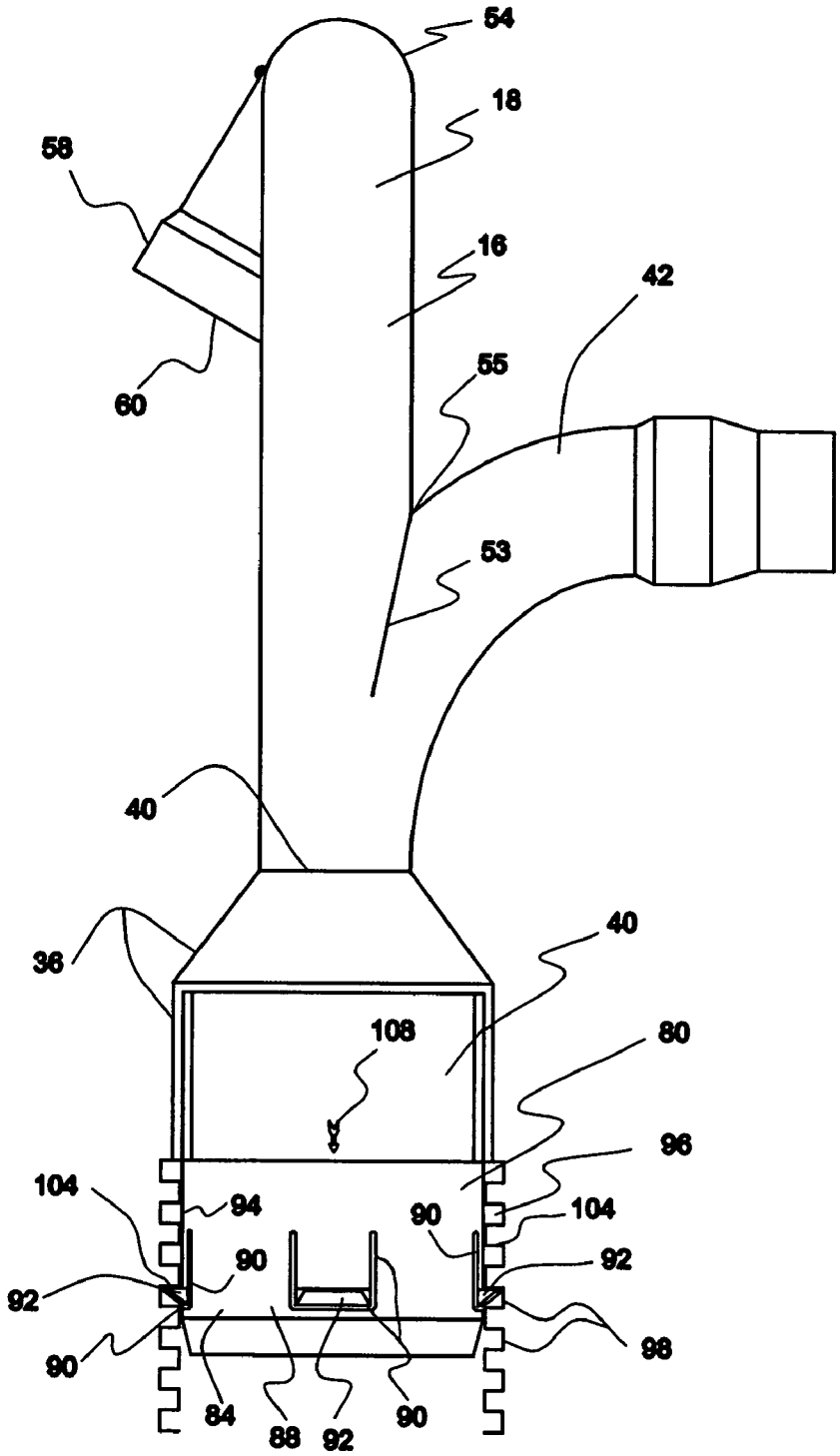
FIG. 6 is a front elevation view of the conduit connector and reducer portion of FIG. 4, but with the quick release fitting inserted into the reducer portion and the quick release fitting inserted into a corrugated vertical conduit in accordance with the present invention.
Figure 7:
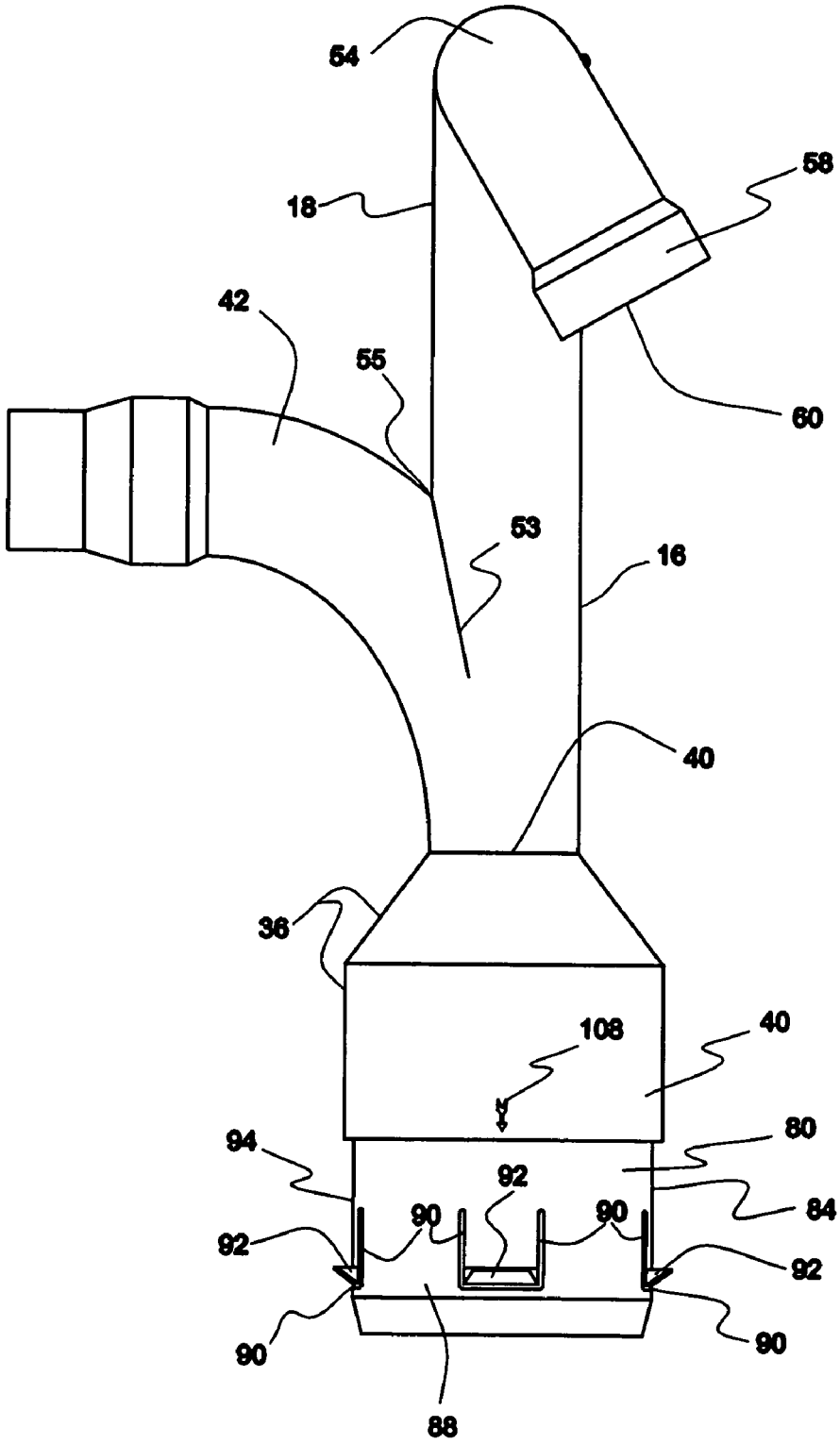
FIG. 7 is the back elevation view of FIG. 5, but with the quick release fitting inserted into the reducer portion.
Figure 8:
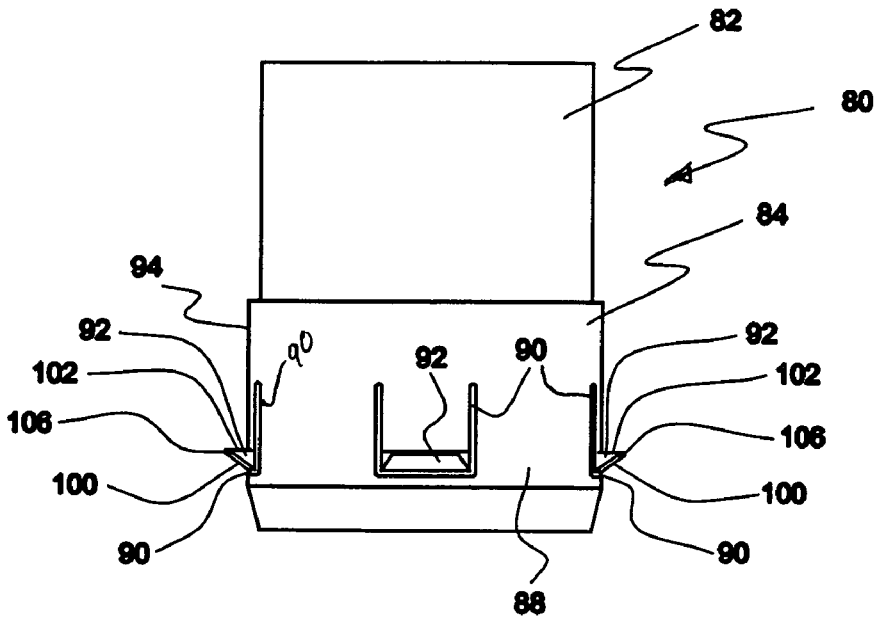
FIG. 8 is the front elevation view of the quick release fitting of FIG. 3.
Figure 9:
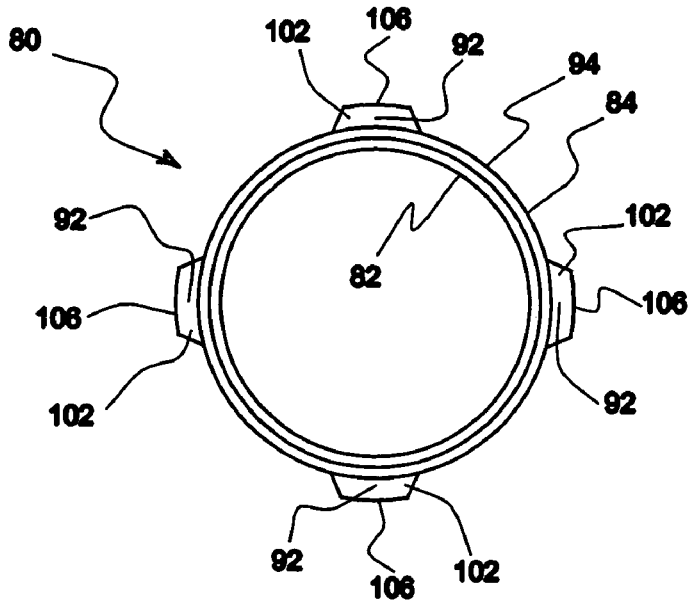
FIG. 9 is a bottom elevation view of the quick release fitting of FIG. 8, FIG. 9 being disposed below FIG. 8 to better understand the configuration of the quick release fitting in accordance with the present invention.

Referring now to the FIGS. 1-9, a device for disbursing underground a liquid discharged from a sump pump 8 in accordance with the present invention is denoted as numeral 10. The device 10 includes an underground liquid disbursing conduit 12 secured (via threads or glue) to a vertical conduit 14 extending upward from the underground liquid disbursing conduit 12 to a connector conduit 16, a bypass member or discharge conduit 18 similarly secured to an upper portion 20 of the connector conduit 16, the bypass member 18 allowing liquid to be discharged above ground in the event the underground liquid disbursing conduit 12 or the vertical extending conduit 14 becoming plugged, and a means for controlling liquid flow (such a block valve 22) from the sump pump 8 to the conduit connector 16 whereby the liquid flow is directed to the liquid disbursing conduit 12 in a closed conduit system.

An existing underground liquid disbursing conduit 12 may be used together with the remaining components of the device 10, however, the condition and capability of the exiting underground conduit 12 for disbursing the liquid flow from the sump pump 8 can only be determined by completing the assembly of the device 10 and hoping that the device 10 operates properly. An indication that the device 10 is not operating properly is a liquid flow from the bypass member 18 upon a ground surface 9.

In the preferred embodiment, an existing or new, substantially horizontal, liquid disbursing conduit 12 disposed substantially horizontal. The conduit 12 is fabricated from polyvinyl chloride ("PVC") or similar plastic, and includes a standard pipe or corrugated pipe configuration having dimensions of substantially about four inches in diameter and a length corresponding directly to the quantity of liquid to be disbursed. Generally, the conduit 12 is buried with a twenty percent downward slope in black dirt substantially about eight inches below ground surface. The length of the conduit 12 is dependent upon soil conditions, the more porous the soil, the better the seepage of liquid through the soil, thus the shorter the conduit 12 length. The underground liquid disbursing conduit 12 includes a plurality of aligned distribution apertures 24 disposed longitudinally in a bottom portion of the conduit 12 such that a distance of substantially about twelve inches separates adjacent apertures 24 thereby facilitating the disbursement of liquid into the soil. The end 26 of the underground liquid disbursing conduit 12 is open and engages a "drain" or pocket 26 of gravel or similar stone that allows liquid that has not disbursed through the apertures 24 to discharge out of the conduit 12 and ultimately into the soil thereby preventing liquid from "backing up" and out the bypass bent, but promoting a liquid underground "pool" that could eventually percolate to the ground surface 9 and damage proximate landscaping.

The vertical conduit 14 may be fabricated from a corrugated plastic pipe used in septic systems, or fabricated from PVC pipe including a combination of standard couplings 30 and forty-five degree elbows 32 or similar fittings well known to those of ordinary skilled in the art to connect the vertical conduit 14 to the substantially horizontal liquid disbursing conduit 12. The couplings and elbows 30 and 32 have diameters equal to the diameter of the liquid disbursing conduit 12. The vertical conduit 14 further includes a riser portion 34 having a diameter similar to that of the elbows 32 (typically four inches), and a longitudinal dimension that disposes an upper end portion 35 above the ground surface 9 to receive a reducer portion 36 that promotes the connection of a two inch diameter vertical pipe portion 38 of the vertical conduit 14 to the liquid disbursing conduit 12. The vertical pipe portion 38 is secured via threads or glue to a lower end 40 of the conduit connector 16 thereby connecting the conduit connector 16 to the liquid disbursing conduit 12.

The connector conduit or conduit connector 16 is a substantially "T" configured PVC fitting that includes an arcuate portion 42 disposed at a mid-portion of the conduit connector 16, the arcuate portion 42 receiving liquid flow from a sump pump discharge conduit 44 and directing the liquid flow downward into the vertical conduit 14 whereby the liquid flow from the sump pump discharge conduit 44 does not flow out of the bypass member during normal operation of the device 10. The arcuate portion 42 redirects a pressurized liquid flow from the substantially horizontal sump pump discharge conduit 44 into the vertical conduit 14. The block valve 22 is disposed in a portion 46 of the sump pump discharge conduit 44 that is inside a structure 48, such as a basement, proximate to a sump pump thereby providing a means for directing liquid flow from the sump pump to the conduit connector 16, and a means for isolating the conduit connector 16 from the sump pump 8.

The dimensions and configuration of the arcuate portion 42 of the conduit connector 16 depend upon the flow rate and discharge pressure from the sump pump 8. Further, should an existing underground liquid disbursing conduit 12 be utilized, the liquid disbursement capacity of the conduit 12 will be an added consideration when designing the arcuate portion 42 for the device 10. More specifically, an industrial grade sump pump will have relatively large flow rates and discharge pressures thereby requiring a special, more expensive conduit connector 16 having a longer and more "vertically" sloped and arcuate portion 50 (see FIG. 2) that extends above the upper portion 20 of the conduit connector 16. Alternatively, a residential grade sump pump will have relatively small flow rates and discharge pressures thereby requiring a typical, less expensive conduit connector 16 having a shorter and more "horizontally" sloped arcuate portion 52.

Knowing the sump pump specifications, and installing a new underground liquid disbursing conduit 12, allows an installer to calculate the configuration and dimensions of the arcuate portion 42 to be used. However, should an existing underground liquid disbursing conduit 12 be incorporated into the device 10, then the configuration and dimensions of the arcuate portion 42 will be determined via trial and error. That is, an installer will select a conduit connector 16 having an arcuate portion 42 that ordinarily is suited for an existing sump pump 8. Should liquid flow be discharged via the bypass member, then a conduit connector 16 having a more vertically sloped arcuate member 50 will be installed to more vertically direct the liquid flow downward into the vertical conduit 14 thereby reducing the liquid flow directed into the bypass member 18 resulting from the more horizontally sloped arcuate member 52. Should the sump pump 8 be overly sized such that liquid discharge occurs irrespective of the configuration and dimensions of the selected conduit connector 16, a flow directing wall 53 is integrally joined to an inner junction edge 55 of the conduit connector 16. The flow directing wall 53 is angularly disposed and dimensioned to extend near the lower end 40 of the conduit connector 16 such that liquid flow can flow only downward into the vertical conduit 14.

The bypass member 18 includes a downward angled portion or elbow 54 having a first end 56 connected to the conduit connector 16 and a second end 58 with a liquid discharge aperture 60 directed toward the ground surface 9. The downward angled portion or elbow 54 prevents objects from falling into the conduit connector 16 thereby plugging the device 10. Also, the elbow 54 prevents an individual proximate to the device 10 from becoming wet should the sump pump 8 direct liquid flow to the device 10 when the liquid disbursing capacity of the device 10 has been exceeded.

The bypass member 18 further includes a liquid flow discharge indicator 62, such as a ping pong ball, to record the discharge of liquid from the bypass member 18 thereby indicating when the upward extending vertical conduit 14 or the underground liquid disbursing conduit 12 is plugged, or when the liquid disbursing capacity of the device 10 has been exceeded. The ping pong ball 62 is secured to a lower end 64 of a string 66 via a hook 67, an upper end 68 of the string 66 is secured to an arcuate rod 72 that is joined to an inner wall 70 of the bypass member 18 such that the ping pong ball 62 is discharged from the bypass member 18 along with the liquid flow from the sump pump 8. Once discharged from the bypass member 18, the ping pong ball 62 remains hanging from the string 66 until an individual sees the ball 62, thus realizing that the device 10 is not disbursing underground liquid flow from the sump pump 8. The ball 62 is easily slid back into the conduit connector 16 via the liquid discharge aperture 60.

The second end 58 of the elbow 54 includes a portion with threads or similar securing means to removably secure a pressurized line to the second end 58 to provide pressurized water to the device 10 to unplug the vertical conduit 14 or the underground liquid disbursing conduit 12. Before supplying pressurized water to the device 10, the block valve 22 must be closed (in the event that a check valve is not present in the discharge line from the sump pump 8), otherwise, the pressurized water would flow through the sump pump and possibly cause damage.

Referring now to FIGS. 3-9, a conduit connector 16 is depicted with an enlarged lower end 40 snugly receiving a PVC quick release fitting 80 therein. The quick release fitting 80 facilitates the quick interchanging of arcuate portions 42 of varying configuration and dimension to ultimately select a device 10 that is capable of disbursing the liquid flow from an existing sump pump 8 irrespective of sump pump 8 size. The quick release fitting 80 includes an insertion portion 82 that removably inserts into the lower end 40 of the conduit connector 16, and a locking end 84 for insertion into the upper end portion 35 of the vertical PVC or corrugated conduit 14. A lower end portion 88 of the locking end 84 includes four circumferentially and equally spaced apertures 90 disposed adjacent to the lower end portion 88. The apertures 90 are substantially "U" configured to form four corresponding resilient locking members or tabs 92 that protrude beyond the cylindrical outer wall 94 of the locking end 84, the tabs 92 ultimately engaging an inner cylindrical wall of a PVC conduit or an inner substantially square configured recess 96 (see FIG. 6) of a corrugated conduit 98. The tabs 92 include an angled portion 100 that promotes the insertion of the tabs 92 into the vertical conduit 14. The tabs 92 further include a top planar wall 102 that is perpendicular to the outer cylindrical wall 94 of the insertion portion 82. The top planar wall 102 ultimately engages a corresponding wall 104 of the inner recess 96 of the corrugated conduit 98 thereby preventing removal of the insertion portion 82 from the corrugated vertical conduit 98. The tabs 92 restrict removal of the insertion portion 82 from a PVC vertical conduit 14 due to "bitting force" of an edge portion 106 of the tabs 92 engaging an inner wall of the PVC pipe. The resilient characteristic of the configuration of the plastic tabs 92 forces the edge portion 106 against the inner wall of the PVC pipe when the tabs 92 are depressed inward by the rigid surface of the inner wall. The tabs 92 are dimensionally small compared to the diameter of the insertion portion 82 to prevent the obstruction of liquid flow entering the vertical conduit 14.

In operation, a device 10 is configured and dimensioned for disbursing underground a liquid discharged from a sump pump 8. An underground liquid disbursing conduit 12 member of the device is disposed substantially about eight inches beneath ground surface 9. A vertical conduit 14 member of the device 10 is connected to the underground liquid disbursing conduit 12, the vertical conduit 14 having an upper end portion 35 disposed above the ground surface 9 to insert into a lower end 40 of a conduit connector 16. The conduit connector 16 includes an arcuate portion 42 that promotes the downward direction of liquid flow from a sump pump discharge conduit 44 through the vertical conduit 14 and into the disbursing conduit 12 for disbursement underground thereby preventing the discharge of liquid flow from a bypass member 18 when the device 10 is operating as intended. Should the vertical or underground conduits 14 and 12 become plugged or "congested" with debris or foreign objects, the liquid flow from the sump pump 8 will exit the device 10 via a discharge aperture 60 in an elbow portion 54 of the bypass member 18. The liquid flow exiting the aperture 60 together with a ping pong ball 62 secured to a string 66 thereby preventing damage to the sump pump 8 and providing indication that flow has discharged from the device 10 above ground, thus informing the sump pump owner that the vertical 14 or underground 12 conduit is plugged. The sump pump owner then proceeds to connect a water hose to the second end 58 of the bypass member 18, close the block valve 22 and opening the water hose valve thereby providing pressurized water to the bypass member 18 to ultimately dissolve the plug and open the conduits 12 and 14.

The insertion portion 82 may be secured to the vertical conduit 14 via a screw or other similar securing means. A centerline arrow 108 is disposed upon the quick release fitting 80 to indicate the centerline of a tab 92 after the insertion portion 82 has been inserted into the vertical conduit 12. The centerline arrow 108 assists an individual when inserting the screw such that the apertures 92 are avoided and the screw anchors into the upper end portion 35 of the vertical conduit 14.

The foregoing description is for purposes of illustration only and is not intended to limit the scope of protection accorded this invention. The scope of protection is to be measured by the following claims, which should be interpreted as broadly as the inventive contribution permits.

The invention claimed is:

1. A device for disbursing underground a liquid discharged from a sump pump comprising: an underground liquid disbursing conduit; a vertical conduit extending upward from said underground liquid disbursing conduit to a connector conduit; bypass means secured to an upper portion of said conduit connector, said bypass means allowing liquid to be discharged above ground in the event said underground liquid disbursing conduit or said vertical extending conduit become plugged, said bypass means including means for preventing objects from falling into said conduit connector, said preventing means including an elbow having a first end connected to said conduit connector, and a second end with a liquid discharge aperture directed toward a ground surface; and means for directing liquid flow from the sump pump to said conduit connector whereby the liquid flow is directed to said liquid disbursing conduit.

2. The device of claim 1 wherein said bypass means includes indicator means to record the discharge of liquid from said bypass means thereby indicating when said upward extending conduit or said underground liquid disbursing conduit is plugged.

3. The device of claim 2 wherein said indicator means includes a ping pong ball secured to a lower end of a string, said string including an upper end secured to an inner wall of said bypass means such that said ping pong ball is discharged from said bypass means via the liquid discharge from said bypass means, said ping pong ball ultimately being seen hanging from said string.

4. The device of claim 1 wherein said second end of said elbow includes means for removably securing a pressurized line to said second end to unplug said upward extending conduit or said underground liquid disbursing conduit.

5. The device of claim 4 wherein said securing means includes a threaded end portion of said second end of said elbow.

6. A device for disbursing underground a liquid discharged from a sump pump comprising: an underground liquid disbursing conduit; a vertical conduit extending upward from said underground liquid disbursing conduit to a connector conduit; bypass means secured to an upper portion of said conduit connector, said bypass means allowing liquid to be discharged above ground in the event said underground liquid disbursing conduit or said vertical extending conduit become plugged; and means for directing liquid flow from the sump pump to said conduit connector whereby the liquid flow is directed to said liquid disbursing conduit, said liquid flow directing means including an arcuate portion that receives liquid flow from a sump pump discharge conduit and directs the liquid flow downward into said vertical conduit, whereby the liquid flow from the sump pump discharge conduit does not flow out of said bypass means during normal operation of said device.

7. The device of claim 6 wherein said liquid flow directing means includes means for isolating said conduit connector from the sump pump.

8. The device of claim 7 wherein said isolating means includes a block valve that prevents liquid from flowing from said conduit connector to the sump pump.

9. A device for preventing plugging of a sump pump liquid disbursing system comprising: a vertical conduit secured to an above ground portion of an existing underground liquid disbursing conduit; a connector conduit having a lower end with an aperture, said lower end being removably secured to an upper portion of an extension conduit, said connector conduit including an upper end and a flow directing portion extending from a mid-portion of said connector conduit, said flow directing portion of said connector conduit including an arcuate portion extending generally downward toward said vertical conduit; a discharge conduit having a first end with an aperture, said first end being removably secured to said upper end of said connector conduit, said discharge conduit having a second end with a liquid discharge aperture directed toward a ground surface; and means for indicating that liquid from the sump pump liquid disbursing device has discharged from said liquid discharge aperture.

10. The device of claim 9 wherein said flow directing portion of said connector conduit includes means for isolating said connector conduit from a sump pump discharge conduit connected to a sump pump.

11. The device of claim 10 wherein said isolating means includes a block valve that prevents liquid from flowing from said connector conduit to the sump pump discharge conduit.

12. A device for preventing plugging of a sump pump liquid disbursing system comprising: a vertical conduit secured to an above ground portion of an existing underground liquid disbursing conduit; a connector conduit having a lower end with an aperture, said lower end being removably secured to an upper portion of an extension conduit, said connector conduit including an upper end and a flow directing portion extending from a mid-portion of said connector conduit, said first end of said flow directing portion extending above said upper end of said connector conduit a predetermined distance that facilitates the path of liquid flow from a sump pump discharge conduit into said vertical conduit; a discharge conduit having a first end with an aperture, said first end being removably secured to said upper end of said connector conduit, said discharge conduit having a second end with a liquid discharge aperture directed toward a ground surface; and means for indicating that liquid from the sump pump liquid disbursing device has discharged from said liquid discharge aperture.

13. The device of claim 12 wherein said indicating means remains visible after liquid flow from said liquid discharge aperture has ceased.

14. The device of claim 13 wherein said indicator means includes a ping pong ball secured to a lower end of a string, said string including an upper end secured to an inner portion of said discharge conduit.

* * * * *